US008037816B2

(12) United States Patent
Gutfleisch et al.

(10) Patent No.: US 8,037,816 B2
(45) Date of Patent: Oct. 18, 2011

(54) MEASUREMENT FIELD FOR DETERMINING THE SMEARING LIMIT DURING PRINTING

(75) Inventors: Martin Gutfleisch, Dossenheim (DE); Axel Hauck, Karlsruhe (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 12/147,549

(22) Filed: Jun. 27, 2008

(65) Prior Publication Data

US 2009/0002430 A1 Jan. 1, 2009

(30) Foreign Application Priority Data

Jun. 28, 2007 (DE) ..... 10 2007 029 929

(51) Int. Cl.
*B41F 7/24* (2006.01)
*B41F 25/00* (2006.01)

(52) U.S. Cl. ..... 101/147; 101/148; 101/465; 101/484; 101/DIG. 45; 101/DIG. 46

(58) Field of Classification Search ..... 101/147, 101/148
See application file for complete search history.

(56) References Cited

U.S. PATENT DOCUMENTS

| | | | |
|---|---|---|---|
| 5,341,734 | A | 8/1994 | Jeschke et al. |
| 6,851,366 | B2 | 2/2005 | Gutfleisch et al. |
| 2004/0090516 | A1 | 5/2004 | Gruetzmacher et al. |

FOREIGN PATENT DOCUMENTS

| | | | |
|---|---|---|---|
| DE | 36 11 631 | A1 | 10/1987 |
| DE | 42 14 139 | C2 | 11/1993 |
| DE | 43 28 864 | * | 3/1995 |
| DE | 43 28 864 | A1 | 3/1995 |
| DE | 195 33 811 | A1 | 3/1997 |
| DE | 102 27 054 | A1 | 12/2003 |
| DE | 102 41 671 | A1 | 3/2004 |
| DE | 103 28 705 | A1 | 1/2005 |

OTHER PUBLICATIONS

German Search Report, dated Nov. 26, 2007.

* cited by examiner

*Primary Examiner* — Joshua D Zimmerman
*Assistant Examiner* — Shema Freeman
(74) *Attorney, Agent, or Firm* — Laurence A. Greenberg; Werner H. Stemer; Ralph E. Locher

(57) ABSTRACT

A measurement field allows determining the smearing limit during printing, in particular during lithographic wet offset printing. The measurement field is arranged on a printing form, in particular a printing plate, which has printing, ink-carrying regions and nonprinting, dampening solution-carrying regions on its surface. A dampening solution-carrying property in the region of the measurement field is reduced by a nanoscopic coating (e.g., with amphiphilic molecules) or an unscreened, microscopic coating (e.g., a polymer coating) in comparison with the dampening solution-carrying property in the nonprinting regions of the surface of the printing form. The nanoscopic coating or the microscopic coating advantageously leads to a shifting of the smearing limit, that is to say to a displacement of the starting point of scumming, by the dampening solution requirement which is increased for scum-free printing within the region of the measurement field. Such a measurement field is thus advantageously used for the closed-loop control of a dampening solution supply.

16 Claims, 2 Drawing Sheets

MEASUREMENT FIELD FOR DETERMINING THE SMEARING LIMIT DURING PRINTING

CROSS-REFERENCE TO RELATED APPLICATION

This application claims the priority, under 35 U.S.C. §119, of German application DE 10 2007 029 929.1, filed Jun. 28, 2007; the prior application is herewith incorporated by reference in its entirety.

BACKGROUND OF THE INVENTION

Field of the Invention

The present invention lies in the printing technology field. More specifically, the invention relates to a measurement field for determining the smearing limit in a printing process. The measurement field is arranged on a printing form which has ink-carrying printing regions and nonprinting, dampening solution-carrying regions on its surface. The invention further relates with such a measurement field and also to a method for preventing scumming during printing with a printing form.

In the lithographic printing process (or the planographic printing process), a printing form is structured during an image setting operation into printing and nonprinting regions (image regions or nonimage regions). The printing regions carry ink and the nonprinting regions carry dampening solution. The printing form is then loaded with dampening solution which settles on the dampening solution-carrying locations of the printing form or wets them and is subsequently provided with printing ink or inked, the printing form accepting printing ink only at the nondamped locations. Since the dampening solution carrying of the printing form is the cause for the inking of the printing form only in the printing regions, the assessing and monitoring of the dampening solution carrying is an essential operation during the production of high quality printed products. If, for example, too little dampening solution is applied to the printing form (i.e., the so-called smearing limit is exceeded), this can lead to printing ink also being accepted at the nonprinting locations of the printing form and these nonprinting locations beginning to be filled with ink or to scum. If, in contrast, too much dampening solution is applied to the printing form, this can lead to the formation of so-called water marks.

Commonly assigned U.S. Pat. No. 5,341,734 and its counterpart German patent DE 42 14 139 C2 described a method for dampening solution regulation (closed-loop control) during printing by a form cylinder in an offset printing press, an energy source, in particular a laser, loading a selected region of a printing plate with energy, with the result that a small, precisely defined and always constant amount of the dampening solution is removed and with the result that clearly visible scumming occurs in this region of the printing image. The selected region of the printing plate and the scumming are monitored by a measuring device and an evaluation/control device. The selected region of the printing plate can be configured, for example, as a specially designed screened field, in particular as a line screen or raster field.

German published patent application DE 103 28 705 A1 describes a method and an apparatus for setting a dampening solution amount which is to be applied to the printing form, energy being input by means of, for example, a laser into a surface which is to remain inkfree or a measurement field, and the energy amount which is detected and evaluated reducing a dampening solution amount which is applied there, for example by evaporation, until the acceptance of ink is detected. The dampening solution amount which is to be applied to the printing form is set as a function of the detected energy amount, preferably in such a way that the surface which is to remain inkfree still just does not accept any ink.

The above-described prior disclosures, U.S. Pat. No. 5,341,734 and DE 42 14 139 C2, as well as DE 103 28 705 A1 require an additional energy source, in particular a laser which increases the cost of the apparatus, in addition to a measuring device or a sensor for the regulation or setting of the dampening solution amount.

Commonly assigned German published patent application DE 43 28 864 A1 describes a method and an apparatus for detecting the smearing limit during offset printing, an inkfree surface zone outside the subject being monitored for ink carrying by way of an optical sensor, in particular an intensity sensor, in order to determine the light which is reflected by the zone. The sensor data are used for controlling and/or regulating the dampening solution supply. The surface zone can be configured as a screen, in particular a precision screen. A screen of this type which does not accept any printing ink in the case of correct printing process control is very sensitive with regard to smearing according to DE 43 28 864 A1, that is to say the onset of scumming is already detected very early, above all earlier than in the remaining inkfree zones. The screen of the corresponding measurement field as a consequence requires a screen unit which, although it is usually provided in plate exposers or printing presses for image setting, would have to be provided additionally and therefore in a manner which increases the costs in the use of separate measurement fields which can be applied to printing plates.

A method from the company Ryobi Limited which has become known under the name "Automatic Aqua Control" measures and monitors, for example, the gloss of the printing form surface which is brought about by the dampening solution and regulates the dampening solution supply via said gloss.

In addition to what are known as conventional printing plates which are often produced from aluminum and are roughened on their surface and provided with a seal and a polymer coating, reimageable printing forms on the basis of a coating with amphiphilic molecules are also known from the prior art. Commonly assigned German patent application DE 102 27 054 A1 describes, for example, a printing form of this type made from naturally oxidized titanium which is treated on its surface with amphiphilic molecules, for example with an (aqueous or ethanolic) solution of phosphoric or hydroxamic acid, and in the process is provided with a nanoscopic coating of amphiphilic molecules. In an image setting step, the amphiphilic molecules can be removed with a laser in the nonprinting, dampening solution-carrying regions which can therefore be loaded with dampening solution during a dampening process.

BRIEF SUMMARY OF THE INVENTION

Against this background it is accordingly an object of the invention to provide a method and a measurement field for determining a smearing limit which overcomes the above-mentioned disadvantages of the heretofore-known devices and methods of this general type and which provides for an improved measurement field that can be evaluated with a small quantity of technical means, and which can be evaluated, in particular, without separate energy sources, such as a laser, and/or can also additionally be produced separately from a printing form with a small amount of technical means, in particular without a screen unit.

With the foregoing and other objects in view there is provided, in accordance with the invention, a measurement field for determining a smearing limit during printing, comprising:

a measurement field disposed on a printing form having a surface formed with one or more ink-carrying printing regions and one or more nonprinting, dampening solution-carrying regions;

a nanoscopic coating or an unscreened, microscopic coating in a region of the measurement field, the nanoscopic coating effecting a reduced dampening solution-carrying property in the region of the measurement field in comparison with a dampening solution-carrying property in the nonprinting, dampening solution-carrying regions of the surface of the printing form.

In other words, a measurement field according to the invention for determining the smearing limit during printing is carried on a printing form which has printing, ink-carrying regions and nonprinting, dampening solution-carrying regions on its surface. The dampening solution-carrying property in the region of the measurement field is reduced, in a first embodiment of the invention, by provision of a nanoscopic coating in the region of the measurement field in comparison with the dampening solution-carrying property in the nonprinting regions of the surface of the printing form. A measurement field which is configured according to the invention in this way can advantageously be used to monitor the dampening solution carrying of the printing form and, in particular, to prevent scumming, complicated technical means, such as lasers, not being necessary in addition to the unavoidable means for the evaluation of the measurement field by measuring technology. Furthermore, a measurement field which is configured according to the invention in this way can also be used in an unscreened manner, with the result that technical means for screening the measurement field are not necessary, in particular in the case of production of the measurement field outside a printing form exposer or a printing press having an exposing function.

As a result of the reduction in the dampening solution-carrying property, or the wettability with dampening solution or the hydrophilicity (in other words: change in the surface energy) in the region of the measurement field, the measurement field tends to already indicate scumming when the dampening solution carrying of the printing form does not yet lead to scumming in the nonprinting, dampening solution-carrying regions. The start of scumming in the nonprinting, dampening solution-carrying regions can therefore already be detected at an early stage via an evaluation of the measurement field and can be prevented by suitable countermeasures, such as an increased dampening solution supply.

According to one advantageous development of the invention, amphiphilic molecules, in particular amphiphilic molecules which are in solution, can be used for the generation of a nanoscopic coating in the region of the measurement field. Here, amphiphilic molecules can be used of the type as are also known from the use in the production of reimageable printing forms, for example phosphonic acid, in particular semiperfluorated alkylphosphonic acid, or hydroxamic acid. The nanoscopic coating with amphiphilic molecules leads to a change, in particular a partial hydrophobicization, of the surface in the region of the measurement field, this change taking place on the nanoscopic (or molecular) scale, that is to say in the range of nanometers and, in particular, up to a maximum of 500 nanometers or a maximum of 100 nanometers or a maximum of 10 nanometers. A nanoscopic coating of this type therefore differs in principle from a coating which is usually applied in thicknesses of preferably micrometers or less preferably millimeters. As a result of the nanoscopic coating in the region of the measurement field, the dampening solution-carrying property in the region of the measurement field is reduced, or the measurement field tends also to increasingly accept ink in comparison with the nonprinting, dampening solution-carrying regions of the printing form and therefore has a greater tendency to scumming than the nonprinting, dampening solution-carrying regions.

According to a further preferred development of the invention, there can be provision for the nanoscopic coating to be screened, preferably by the use of an image setting device. Although, as described above, screening is not necessary, it can also be advantageous to screen the nanoscopic coating under some circumstances, such as when producing the measurement field separately from the printing form. As a result of the screening of the nanoscopic coating, the dampening solution-carrying property in the region of the measurement field can be set in a targeted manner and therefore the behavior of the measurement field with regard to the dependence of scumming on the dampening solution amount can also be set in a targeted manner.

In a second exemplary implementation of the invention, the dampening solution-carrying property in the region of the measurement field is reduced by provision of an unscreened, microscopic coating in the region of the measurement field in comparison with the dampening solution-carrying property in the nonprinting regions of the surface of the printing form. A measurement field of this type which is produced according to the invention can be evaluated with reduced effort in terms of technical means, like the measurement field according to the invention which has already been described above, and, moreover, can likewise be produced with a small number of technical means by the provision of an unscreened coating (i.e., unscreened), in particular without a separate unit for screening, if the measurement field is not produced in a printing form exposer or in a printing press having an exposing function.

In contrast to the above-described nanoscopic coating, a microscopic coating is then applied, it being possible for the microscopic coating to preferably have a layer thickness in the range from approximately 0.5 micrometer to approximately 500 micrometers.

According to one preferred development of the measurement field according to the invention, there can be provision for the microscopic coating to cause smoothing in the region of the measurement field. In other words, the region of the measurement field is distinguished by a smoother surface structure than the nonprinting regions of the surface of the printing form. As a result of the smoothing in the region of the measurement field, the measurement field tends, on account of a changed capillary action of the surface, to be more likely to accept ink and therefore to be more likely to scum than the nonprinting, dampening solution-carrying regions of the printing form.

According to one preferred development, a measurement field according to the invention having a nanoscopic coating or an unscreened, microscopic coating can be distinguished by the fact that the nanoscopic coating or the microscopic coating leads to a shifting (i.e., displacement) of the smearing limit as a result of the dampening solution requirement which is increased for scum-free printing within the region of the measurement field. As a result of the displacement of the smearing limit, that is to say as a result of the displacement of the incipient scumming as a function of the dampening solution requirement within the region of the measurement field, the measurement field is advantageously suitable for being used during the monitoring of scum-free printing, since the measurement field itself already begins to scum at a dampening solution supply which does not yet lead to scumming in the region of the nonprinting, dampening solution-carrying regions.

According to one advantageous development of the measurement field according to the invention with a nanoscopic coating or an unscreened, microscopic coating, there can be provision for the measurement field to be formed as part of the surface of the printing form. In other words, the measurement field forms a region of the printing form surface and can advantageously be produced, for example, by the image setting process of the printing form. As an alternative to this, according to a further advantageous development, a measurement field according to the invention with a nanoscopic coating or an unscreened, microscopic coating can be distinguished by the fact that the measurement field is formed separately on the surface of the printing form, in particular is applied to the surface of the printing form. A measurement field of this type can advantageously be produced separately from the printing form, for example on film, and can be applied to the surface of the printing form. For example, the formation of the measurement field as an adhesive element which is adhesively bonded onto the surface of the printing form is conceivable.

A printing form, in particular a lithographic wet offset printing form which is distinguished by at least one measurement field as described above in relation to the invention is also to be considered to be within the scope of the invention. A printing form according to the invention can therefore have one measurement field according to the invention or else a plurality of measurement fields according to the invention which can be of identical or different configuration.

A method according to the invention for preventing scumming during printing with a printing form is distinguished by the fact that a measurement field as described above in relation to the invention is provided on the printing form, that this measurement field is evaluated by measuring technology during continuous printing in order to obtain a controlled variable, and that regulation of the dampening solution supply takes place on the basis of said controlled variable. The value "distance from the smearing limit" is advantageously suitable as controlled variable, which value is determined during incipient scumming within the region of the measurement field and indicates that the dampening solution supply of the printing form has reached a value which should not be undershot, since otherwise incipient scumming is to be expected in the region of the nonprinting, dampening solution-carrying regions. The regulation of the dampening-solution supply will therefore ensure that the dampening solution supply is increased until no more scumming can be seen in the region of the measurement field. The method according to the invention therefore advantageously directly uses the value "distance from the smearing limit" for the regulation to a setpoint value and not a value which is merely dependent thereon, such as the gloss which also depends on other disruptive influences. The above-described moisture regulation method can advantageously be integrated into a controller of a printing press such as "Prinect® Inpress Control" of Heidelberger Druckmaschinen A G.

The above-described invention and the above-described, advantageous developments of the invention also represent advantageous developments of the invention in combination with one another. For example, the use of a measurement field, which is formed on a reimageable printing form, with a nanoscopic coating of amphiphilic molecules, as are also used for image setting of the printing form, is of particular advantage.

Other features which are considered as characteristic for the invention are set forth in the appended claims.

Although the invention is illustrated and described herein as embodied in measurement field for determining the smearing limit during printing, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
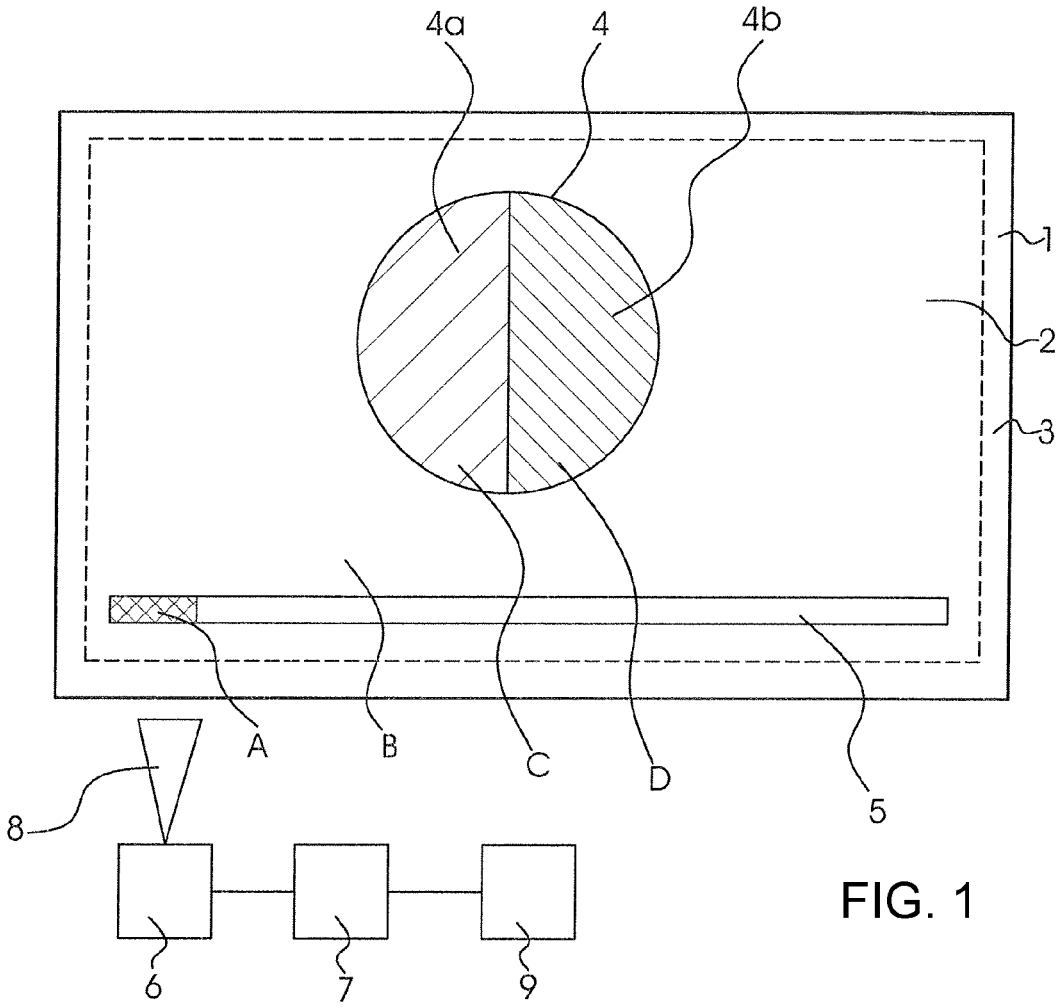
FIG. 1 is a plan view onto one preferred exemplary embodiment of a printing form according to the invention with a measurement field according to the invention.

Referring now to the figures of the drawing in detail and first, particularly, to FIG. 1 thereof, a printing form 1 according to the invention may, for example, be a lithographic offset printing plate which can be imaged once or multiple times, for use in lithographic offset printing or in lithographic offset printing presses. The printing form 1 has a usable region 2 (within the dashed box) which is surrounded by a nonusable edge 3. The printing form 1 is exposed in the usable region 2 with a printing image 4. Here, by way of example, the image is a circle which is composed of a full tone area 4*a* or C and a half tone area 4*b* or D. The regions C and D therefore form printing, ink-carrying regions, while the region B represents a nonprinting, dampening solution-carrying region. Furthermore, the printing form 1 has a printing control strip 5 which is configured in a conventional way in the vicinity of the edge.

A measurement field A according to the invention which can be integrated, for example, as shown in FIG. 1, into the printing control strip 5 is formed on the printing form 1. However, it is also possible to arrange the measurement field A outside the printing control strip 5 or to arrange it at any desired location of the printing form 1 within the usable region 2. The arrangement within the printing control strip 5 is preferred, however, since printing control strips of this type are monitored, that is to say monitoring devices are often arranged in such a way that they can detect the printing control strips of transported printed sheets.

A nanoscopic coating (cf. FIG. 2) or an unrastered (nonscreened), microscopic coating (cf. FIG. 3) can be provided within the region of the measurement field A, which coating equips the measurement field A with a function which allows beginning or incipient scumming to be detected early, that is to say in time to take counter-measures. The smearing limit is shifted (i.e., displaced) by the nanoscopic coating or the microscopic coating within the region of the measurement field A by the dampening solution requirement, which is increased for scumfree printing, within the region of the measurement field in such a way that scumming already begins within the region of the measurement field in the case of a dampening solution supply which does not yet lead to scumming in nonprinting, dampening solution-carrying regions B of the printing form 1.

The measurement field A lies in the observation region 8 of a measuring unit 6 which carries out, for example, a density measurement in the region of the measurement field for detecting the incipient scumming and which is connected to a regulating unit 7 which in turn regulates the dampening solution application to the printing form 1 via a dampening unit 9. As an alternative, instead of the printing form, the printed measurement field can also be measured on a printing material, in particular a sheet.

Figure 2:
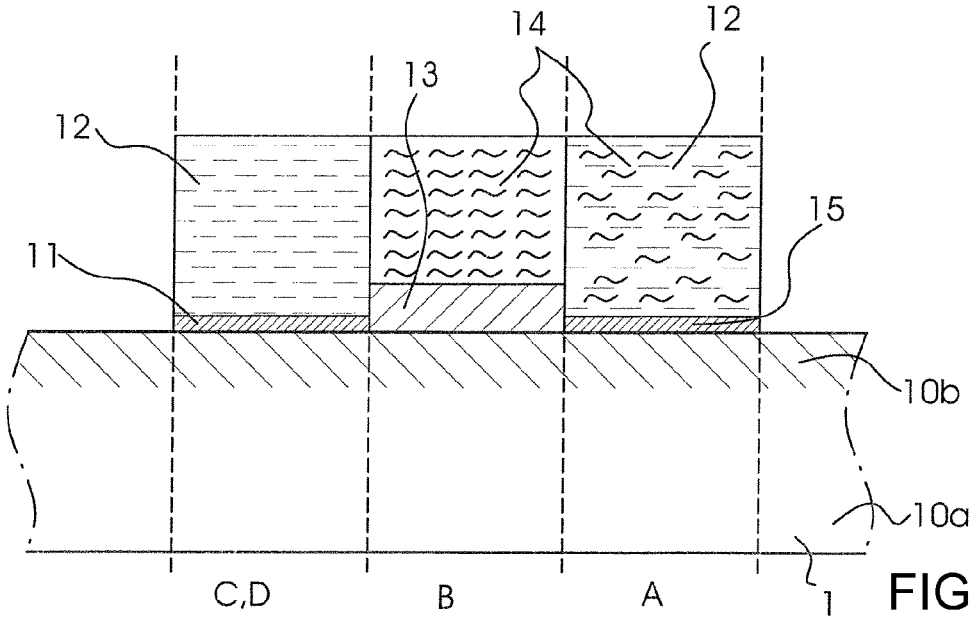
FIG. 2 is a diagrammatic sectional view through a preferred exemplary embodiment of a printing form according to the invention with a measurement field according to the invention.

In the diagrammatic sectional view which is shown in FIG. 2, a printing form 1 can be seen which is composed of a metal or a metallic region 10*a* and a metal oxide or a region comprising metal oxide 10*b* on the surface of the printing form 1. In one preferred embodiment, the metal is titanium and the metal oxide is naturally oxidized titanium (titania). The printing form 1 which is shown in FIG. 2 is a reimageable printing form which is provided with a nanoscopic coating 11 in the ink-carrying regions C and D, the nanoscopic coating being shown with a thickness, only for improved illustration, although the nanoscopic coating as explained above is only a change in the surface in the molecular range. The printing form carries printing ink 12 in the ink-carrying regions C and D, that is to say in the regions with a nanoscopic coating 11. In contrast, the printing form carries a dampening solution 14 in the nonprinting, dampening solution-carrying regions B which can optionally be provided with a rubber coating 13.

The printing form 1 carries dampening solution 14 in the region of the measurement field A which, according to the exemplary embodiment, is provided with a nanoscopic coating 15; however, it also tends to accept printing ink 12 in the region A. The ink acceptance behavior in the region of the measurement field A can be controlled or set, for example, by the selection of the concentration of the (aqueous or ethanolic) solution of amphiphilic molecules which is used to produce the nanoscopic coating 15 or by the selection of the duration of the operation for producing a nanoscopic coating. For example, in order to produce the nanoscopic coating 15, an aqueous solution of amphiphilic molecules, for example phosphonic acid or hydroxamic acid, can be used which has a lower concentration than the solution for producing the nanoscopic coating 11 in the ink-carrying regions C and D. In particular, the concentration can be selected to be so low that predominantly a dampening solution-carrying property dominates within the region of the measurement field A, an ink-carrying property below the threshold existing as a result of the nanoscopic coating 15, with the result that ink acceptance takes place in the region of the measurement field A in the case of excessively low dampening solution supply and said measurement field A begins to scum as a result.

Figure 3:
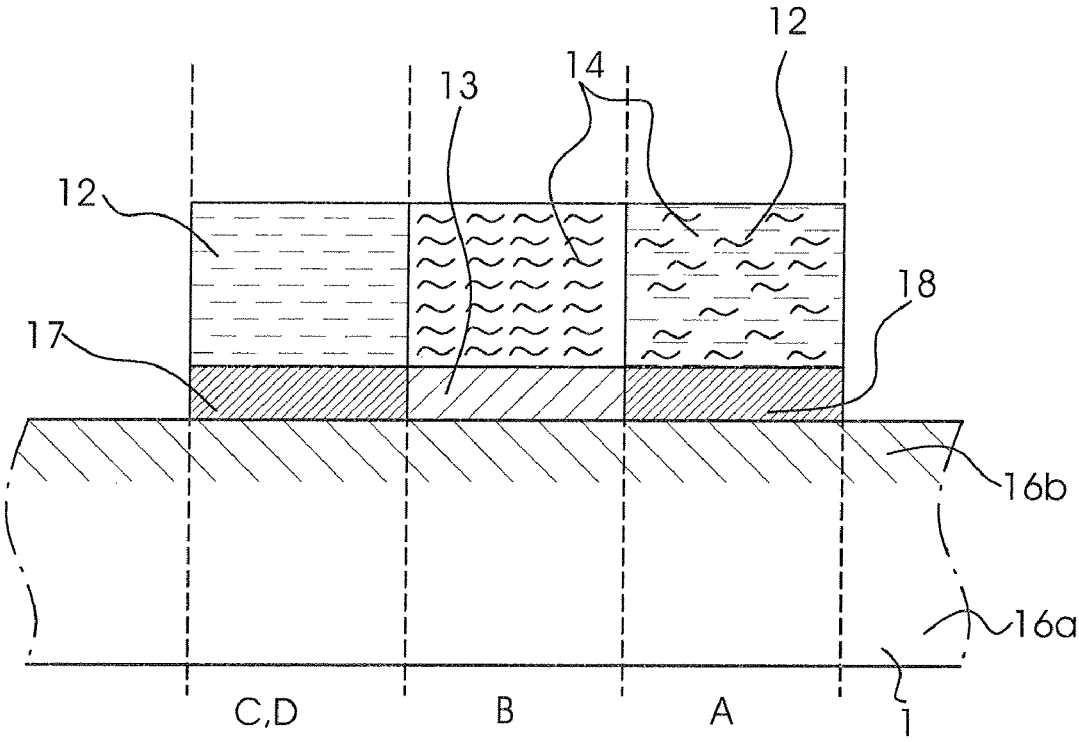
FIG. 3 is a diagrammatic sectional view through a preferred exemplary embodiment of a further printing form according to the invention with a further measurement field according to the invention.

The exemplary embodiment which is shown in FIG. 3 shows a printing form 1 according to the invention with a measurement field A according to the invention, the printing form 1 having a metal 16*a* and a metal oxide 16*b* on the surface of the printing form 1, for example aluminum and aluminum oxide (alumina).

In the ink-carrying regions C and D, the printing form 1 has a coating 17, for example a polymer coating, as there is in conventional printing plates, which coating carries a printing ink 12. The printing form 1 can optionally have a rubber coating 13 in the dampening solution-carrying regions B, dampening solution 14 being carried in the regions B. In the region of the measurement field A, the printing form 1 has a microscopic coating 18, for example a polymer coating, which predominantly has a dampening solution-carrying property and has an ink-carrying property below the threshold, with the result that scumming can be detected in the region of the measurement field A in the case of excessively low dampening solution supply, and increased dampening solution supply can take place via regulation. The polymer coating can be set, for example, by application of an extremely diluted and/or chemically modified polymer solution which is nevertheless known for printing plate coating, in such a way that there is predominantly a dampening solution-carrying property. As an alternative, a metal coating (for example, titanium or stainless steel), a metal oxide coating or a semiconductor/semiconductor oxide coating such as silicon can be provided which advantageously can additionally be provided with a nanoscopic coating which varies the wetting property.

It is also possible within the scope of the invention to provide a plurality of measurement fields A, for example in a series arrangement, the respective smearing limit of which, that is to say the respective starting point of scumming which is dependent on the dampening solution supply, is selected to be different, with the result that the different measurement fields A display scumming one after another as the dampening solution supply reduces and can therefore be used together for the regulation of the dampening solution supply.

Furthermore, it is also conceivable within the scope of the invention to provide two measurement fields A, of which one does not scum given ideal dampening solution supply, while the other already scums given ideal dampening solution supply, with the result that in turn both measurement fields can be used jointly for the regulation of the dampening solution supply.

The measurement field A can be produced before, during or after image setting of the printing form 1. The simultaneous production with the use of existing technical means for the image setting is preferred, such as applicator units for substances for nanoscopic coating or image setting lasers for screening the coating.

As an alternative, a change in the capillary structure by targeted removal of the pore sealing of roughened aluminum oxide printing forms can also be provided to produce a measurement field.

The invention claimed is:

1. A printing form comprising:

one or more ink-carrying, printing regions, one or more dampening solution-carrying, non-printing regions, and a smearing limit measurement field;

said smearing limit measurement field including a nanoscopic coating;

said nanoscopic coating having an increased dampening solution-carrying property in comparison with the one or more ink-carrying, printing regions and a reduced dampening solution carrying property in comparison with the said one or more dampening solution-carrying, non-printing regions.

2. The printing form according to claim 1, when said nanoscopic coating includes amphiphilic molecules.

3. The printing form according to claim 1, wherein said nanoscopic coating is screened.

4. The printing form according to claim 1, wherein said nanoscopic coating is configured to cause a shifting of the smearing limit by increased dampening solution consumption for scum-free printing within the smearing limit measurement field.

5. The printing form according to claim 1, wherein the smearing limit measurement field forms as part of the surface of the printing form.

6. The printing form according to claim 1, wherein the smearing limit measurement field is formed separately on the surface of the printing form.

7. The printing form according to claim 1, wherein the smearing limit measurement field is deposited separately on the surface of the printing form.

8. A printing form comprising:

one or more ink-carrying, printing regions, one or more dampening solution-carrying, non-printing regions, and a smearing limit measurement field;

said smearing limit measurement field including an unscreened, microscopic coating;

said unscreened, microscopic coating having an increased dampening solution-carrying property in comparison with the one or more ink-carrying, printing regions and a reduced dampening solution carrying property in comparison with the said at least one dampening solution-carrying, non-printing regions.

9. The printing form according to claim 8, wherein said unscreened, microscopic coating is configured to cause smoothing in the smearing limit measurement field.

10. The printing form according to claim 8, wherein said unscreened, microscopic coating is configured to cause shifting of the smearing limit by increased dampening solution consumption for scum-free printing within the smearing limit measurement field.

11. The printing form according to claim 8, wherein the smearing limit measurement field forms as part of the surface of the printing form.

12. The printing form according to claim 8, wherein the smearing limit measurement field is formed separately on the surface of the printing form.

13. The printing form according to claim 8, wherein the measurement field is deposited separately on the surface of the printing form.

14. The printing form according to claim 8 configured as a wet offset printing form.

15. A method for preventing scumming during printing with a printing form, the method comprising:

providing a printing form according to claim 1;

evaluating the smearing limit measurement field with a measuring technology-relevant apparatus during continuous printing in order to obtain a controlled variable; and subjecting a dampening solution supply to closed loop control on a basis of the controlled variable.

16. A method for preventing scumming during printing with a printing form, the method comprising:

providing a printing form according to claim 8;

evaluating the smearing limit measurement field with a measuring technology-relevant apparatus during continuous printing in order to obtain a controlled variable; and subjecting a dampening solution supply to closed loop control on a basis of the controlled variable.

* * * * *